US007721448B2

(12) United States Patent
Kao

(10) Patent No.: US 7,721,448 B2
(45) Date of Patent: May 25, 2010

(54) FOLDING KNIFE WITH A HOLLOW HANDLE FOR FASTENING AN ITEM THEREIN

(76) Inventor: Chih-Chen Kao, No. 109, Jhonghua Rd., Taoyuan City, Taoyuan County (TW)

( * ) Notice: Subject to any disclaimer, the term of this patent is extended or adjusted under 35 U.S.C. 154(b) by 347 days.

(21) Appl. No.: 12/068,384

(22) Filed: Feb. 6, 2008

(65) Prior Publication Data

US 2009/0193663 A1 Aug. 6, 2009

(51) Int. Cl.
*B26B 11/00* (2006.01)
*B26B 1/02* (2006.01)

(52) U.S. Cl. ..... 30/161; 30/143; 30/155; 7/118; 7/158

(58) Field of Classification Search ..... 30/155–161, 30/142, 143; 7/118, 119, 158; D8/99; D27/142
See application file for complete search history.

(56) References Cited

U.S. PATENT DOCUMENTS

D172,725 S * 7/1954 Polk ..... D27/142
2,826,813 A * 3/1958 Flocke ..... 30/159
2,828,855 A * 4/1958 Mosch ..... 206/234
2,982,454 A * 5/1961 Wolberg ..... 224/241
4,373,223 A * 2/1983 Miller ..... 7/151
4,642,827 A * 2/1987 Karuzas ..... 7/151
5,829,965 A * 11/1998 Rubalcava ..... 431/253
D411,091 S * 6/1999 Halligan ..... D8/99
6,101,722 A * 8/2000 Cheng ..... 30/155
6,101,724 A * 8/2000 Halligan ..... 30/161
D464,168 S * 10/2002 Reynolds et al. ..... D27/142
6,675,484 B2 * 1/2004 McHenry et al. ..... 30/161
D492,568 S * 7/2004 Allen ..... D8/99
D605,021 S * 12/2009 Noraker ..... D8/99
2005/0183268 A1 * 8/2005 Chen ..... 30/161
2006/0262518 A1 * 11/2006 Thuma et al. ..... 362/119

FOREIGN PATENT DOCUMENTS

DE 197 45 510 A1 * 6/1998

* cited by examiner

*Primary Examiner*—Hwei-Siu C Payer
(74) *Attorney, Agent, or Firm*—Bacon & Thomas, PLLC

(57) ABSTRACT

A folding knife comprises a blade and a handle, wherein the handle is formed by bending a metal sheet into a shape of inverted U-section for clamping an item (e.g., a lighter) therein and comprises a latch formed by punching on one side thereof adjacent to the receiving space in a direction opposite to the receiving space. The blade has one end pivotably secured to one end of the other side of the handle having the latch and the one end of the blade is lockingly fastened by the latch when the blade is in its opened position. The blade is unfastened when a predetermined pressing force is exerted on the latch toward the receiving space such that the blade may pivotably retract onto the other side of the handle. Thus, the folding knife can be mounted with the item (e.g., the lighter) for the functions of cutting and lighting.

5 Claims, 3 Drawing Sheets

FOLDING KNIFE WITH A HOLLOW HANDLE FOR FASTENING AN ITEM THEREIN

FIELD OF THE INVENTION

The invention relates to folding tools and more particularly to a folding knife with an inverted U-shaped hollow handle having a locking mechanism for fastening an item (e.g., lighter) therein.

BACKGROUND OF THE INVENTION

Science and technologies have made significant progress in these several decades resulting in a significant improvement of living quality. Moreover, many advanced products are commercially available because manufacturers have made great efforts in research and development. Quality is also pursued by the manufacturers and it is hoped that a user may conveniently use a product produced by them.

Folding knifes are widely used by people especially people loving outdoor activities due to its utility and portability. Hence, a wide variety of folding knifes are available.

Cigars are produced by rolling tobacco leaves and are without a filter. This is a contrast to cigarette which has a filter. A person has to make an opening at one end of a cigar prior to smoking. Typically, a cigar knife is used to cut an opening at one end of a cigar prior to lighting the cigar with a lighter. However, such method of lighting a cigar is very inconvenient to persons loving cigar smoking. In addition, a person may not be able to enjoy cigar smoking if a lighter or a cigar knife is not available at hand.

A person loving outdoor activities may bring many different items in an outing. A person may forget where an item is correctly located. It is thus often that an anxious person may spend a lot of time on finding an item when a need arises. Knives and lighters are two kinds of tool that are frequently used by people. Unfortunately, people tend to forget their correct locations due to poor memory. As an end, a person cannot find the missing knife or lighter in most cases.

Conventionally, folding knife manufacturers concentrate their effort on how to improve construction and/or quality of a folding knife. Therefore, a varieties of improved folding knife are commercially available. Also, folding knife market is very competitive, resulting in a drop of folding knife sales per manufacturer. It is aware by the inventor that very few folding knifes have an additional function other than cutting (i.e., multifunctional folding knife). For example, folding knife manufacturers have not developed a folding knife being capable of storing or retaining an item. Hence, conventional folding knifes still lack convenience.

It is thus desirable among manufacturers of the art to provide a novel, multifunctional folding knife in order to not only overcome the inadequacy of the prior art but also bring additional convenience to folding knife users.

SUMMARY OF THE INVENTION

After considerable research and experimentation, an improved folding knife being convenient in use and having a hollow handle for fastening an item therein according to the invention has been devised so as to overcome the above drawback of the prior art.

It is an object of the invention to provide a folding knife comprises a handle and a blade. The handle is formed by bending a metal sheet into a shape of inverted U-section. The handle thus comprises a receiving space of inverted U-section. The receiving space is adapted to fasten an item (e.g., a lighter) therein. The lighter is clamped by both sides of the handle adjacent to the receiving space when the lighter is retained in the handle. The handle further comprises a latch formed by punching on one side thereof adjacent to the receiving space in a direction opposite to the receiving space, a clip formed by punching on another side thereof adjacent to the receiving space in a direction opposite to the receiving space and a lengthwise, outward extending flange formed by bending the edge of the other side having the latch in a direction opposite to the receiving space. The blade has the rear end pivotably secured to the front end of the other side of the handle having the latch. The rear end of the blade is lockingly fastened by the front end of the latch when the blade is in its opened position. The blade is unfastened when a predetermined pressing force is exerted on the flexible latch toward the receiving space such that the blade may pivotably retract onto the other side of the handle. The flange is adapted to stop a cutting edge of the blade when retracting the blade onto the other side of the handle. In this closed position of the folding knife, the cutting edge of the blade disposing proximate the flange is prevented from accidentally cutting a user. The latch has a first positioning member at its front end. The blade has a second positioning member on an inner surface at its rear end. The blade is secured onto the other side of the handle by matingly engaging the second positioning member with the facing first positioning member. A user has to exert a sufficient force to disengage the second positioning member from the first positioning member prior to pivoting the blade to its opened position. By utilizing this folding knife, many advantages are obtained. These advantages include being simple in construction, easy to manufacture, compact, portable, and easy to use. Moreover, the lighter can be mounted in the folding knife so that the folding knife can have the functions of cutting and lighting.

In one aspect of the invention the folding knife having a hollow handle for fastening an item therein has the advantages including simple in construction, easy to manufacture, and low in the manufacturing cost. Moreover, an item (e.g., a lighter) mounted in the folding knife is of conventional inexpensive type and is commercially available. It is easy to assemble the folding knife and the lighter together. Further, both the folding knife and the lighter are inexpensive. Hence, a user may not have the feeling of losing a precious thing when the folding knife is lost accidentally.

The above and other objects, features and advantages of the invention will become apparent from the following detailed description taken with the accompanying drawings.

DETAILED DESCRIPTION OF THE PREFERRED EMBODIMENTS

Figure 1:
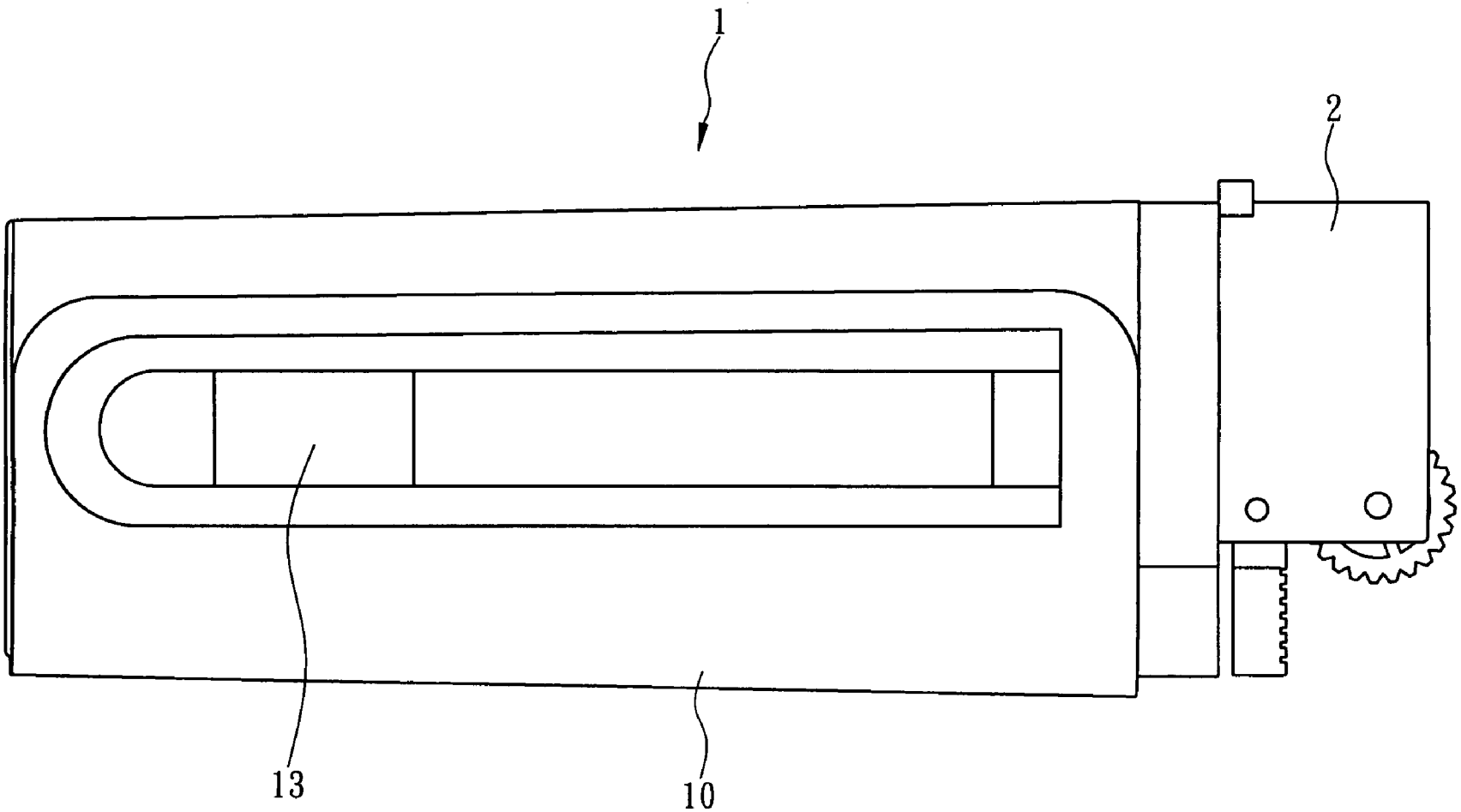
FIG. 1 is a side view of a preferred embodiment of folding knife according to the invention, showing the folding knife in a closed position with a lighter being secured thereto.
Figure 2:
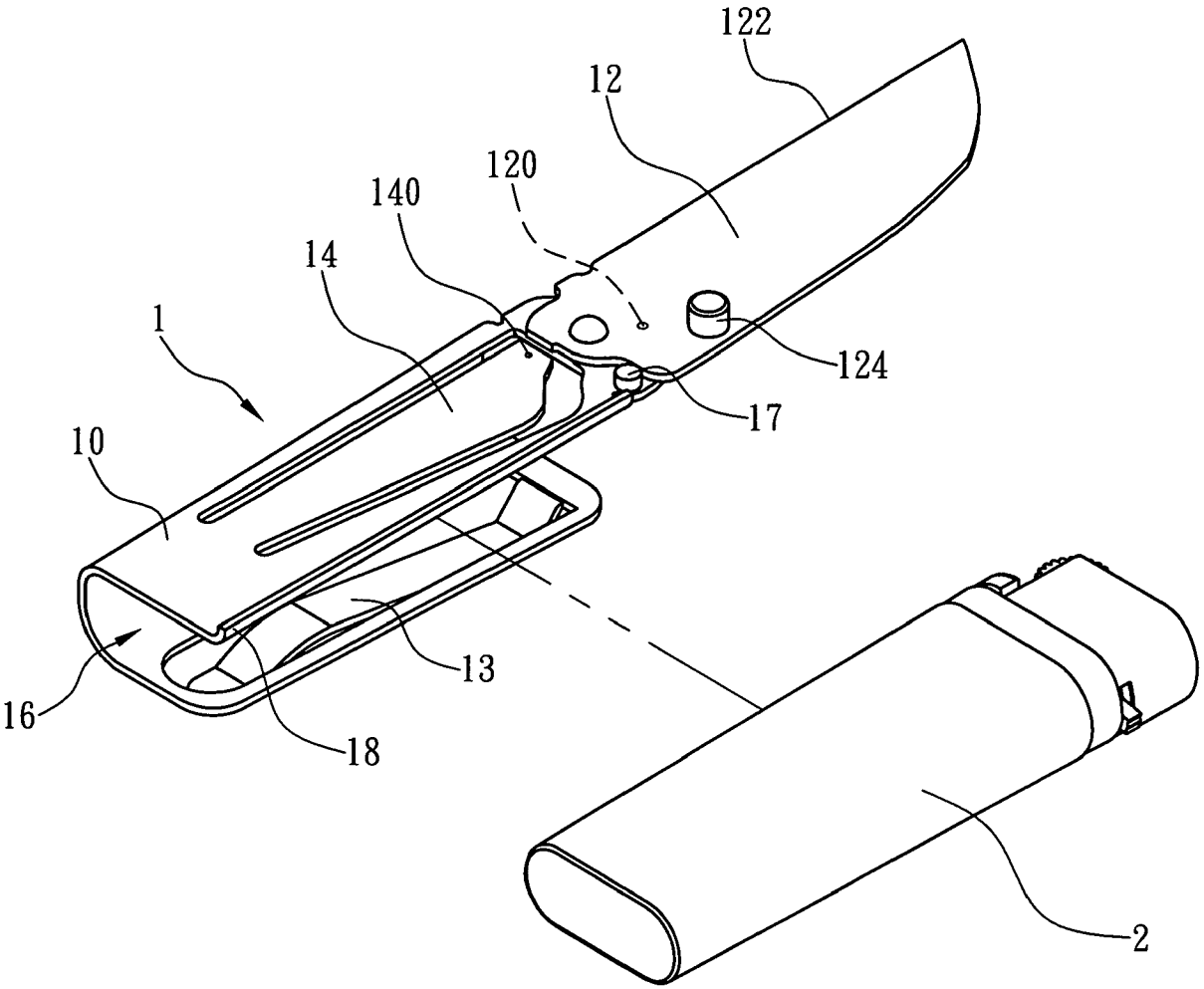
FIG. 2 is an exploded view of the folding knife and the lighter, showing the folding knife in an opened position.
Figure 3:
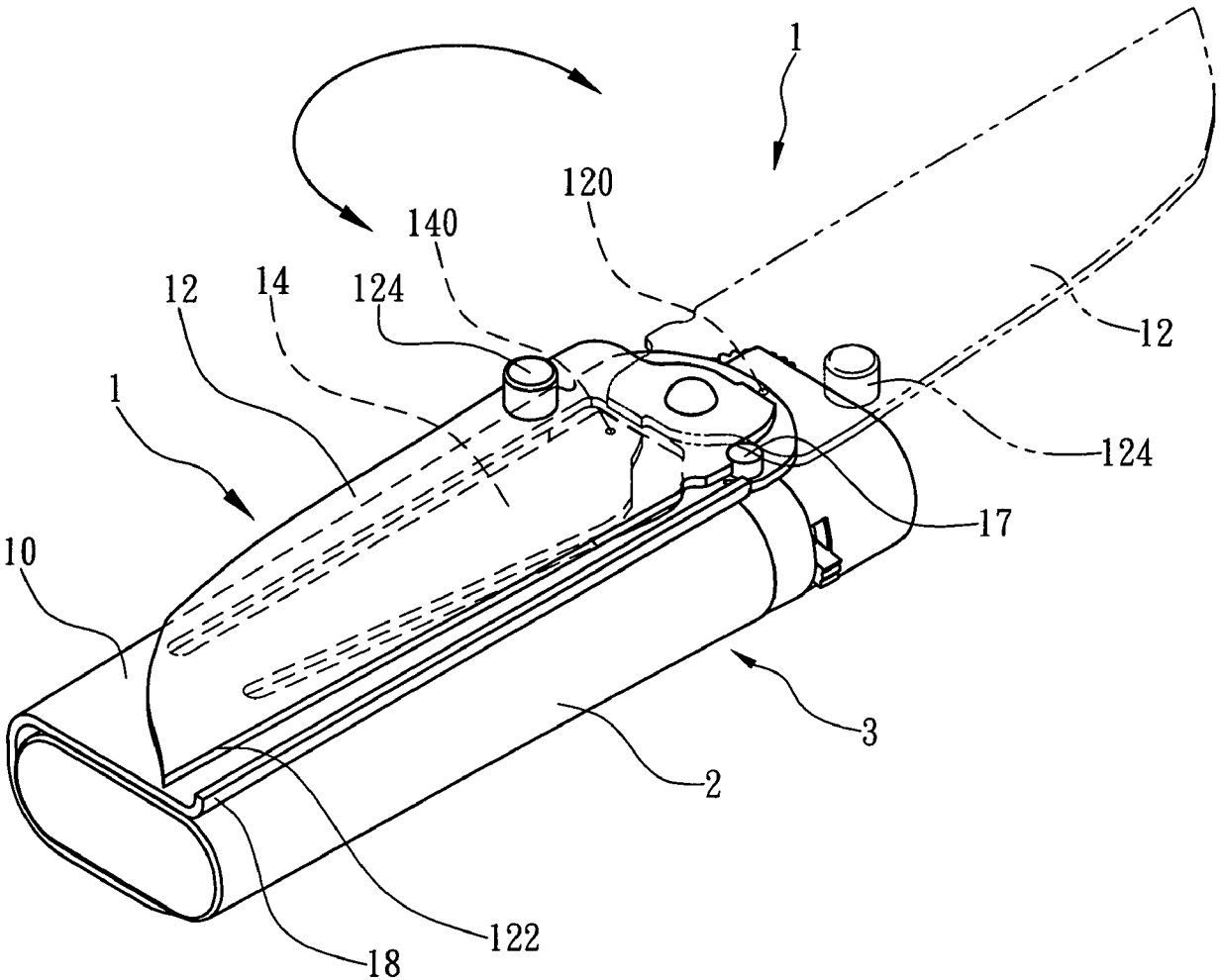
FIG. 3 is a perspective view of the folding knife and the lighter, showing the folding knife in either an open or a closed position and the lighter being in the handle.

Referring to FIGS. 1 to 3, a folding knife 1 in accordance with a preferred embodiment of the invention comprises a handle 10 and a blade 12. Each component is discussed in detail below.

The handle 10 is formed by bending a metal (e.g., stainless steel) sheet into a member of inverted U-section. The handle 10 thus has a receiving space 16 of inverted U-section (i.e., open to the bottom). The receiving space 16 is adapted to fasten an item (e.g., a lighter) 2 therein. That is, the lighter 2 is clamped by both sides of the handle 10 (i.e., both sides of the receiving space 16) when the lighter 2 is retained in the handle 10. The handle 10 further comprises a latch 14 formed by punching on one side of the handle 10 (i.e., on the other side of the receiving space 16) adjacent to the receiving space 16 in a direction opposite to the receiving space 16, a clip 13 formed by punching on another side of the handle 10 (i.e., on one side of the receiving space 16) adjacent to the receiving space 16 in a direction opposite to the receiving space 16, and a lengthwise, outward extending flange 18 formed by bending the edge of the other side of the handle 10 in a direction opposite to the receiving space 16.

The blade 12 has the rear end pivotably secured to the front end of the other side of the handle 10 (i.e., the side with the latch 14 formed thereon). The rear end of the blade 12 is fastened by the front end of the latch 14 when the blade 12 is in its opened position. Thus, the blade 12 is retained. The blade 12 is unfastened when a sufficient pressing force is exerted on the latch 14 toward the receiving space 16. Thereafter, the blade 12 can retract onto the other side of the handle 10 by pivoting. In this closed position, a cutting edge 122 of the blade 12 is disposed proximate the flange 18 which serves as a guard for preventing the cutting edge 122 from accidentally cutting a user.

The latch 14 has a first positioning member 140 at its front end. The blade 12 has a second positioning member 120 on an inner surface at its rear end. The blade 12 is secured onto the other side of the handle 10 by matingly engaging the second positioning member 120 with the facing first positioning member 140 (see FIG. 3). A user has to exert a force to disengage the second positioning member 120 from the first positioning member 140 prior to pivoting the blade 12 to its opened position.

The folding knife 1 is advantageous for being simple in construction, easy to manufacture, compact, portable, and easy to use. Moreover, the lighter 2 can be mounted in the folding knife 1 so that the folding knife 1 can have the functions of cutting and lighting as detailed below.

Referring to FIG. 3 again, the preferred embodiment of the invention is shown. The lighter 2 is clamped by both sides of the handle 10 when the lighter 2 is retained in the handle 10 (see FIG. 2). Thus, the handle 10 and the lighter 2 are assembled as a holding unit 3. A user may easily assemble the folding knife 1 and the lighter 2 together prior to taking an outdoor activity (e.g., hiking, mounting climbing, camping, rock climbing, etc.) This has the benefit of preventing a user from forgetting where either one of the folding knife 1 and the lighter 2 is located when a need arises.

Referring to FIG. 3 again, use and inoperative states of the preferred embodiment of the invention are illustrated. The latch 14 has a first positioning member 140 at its front end. The blade 12 has a second positioning member 120 on an inner surface at its rear end (see dotted lines). The blade 12 is secured onto the other side of the handle 10 by matingly engaging the second positioning member 120 with the facing first positioning member 140. A user has to exert a force to disengage the second positioning member 120 from the first positioning member 140 prior to pivoting the blade 12 to its opened position. This has the benefit of preventing the blade 12 from accidentally cutting a user when the blade 12 is in its closed position.

A protrusion 124 is formed on an outer surface of the blade 12 proximate the rear end of the blade 12. A user may exert a sufficient force on the protrusion 124 to pivot the blade 12 from its closed position (solid lines) to its predetermined opened position (dotted lines). At this opened position, the rear end of the blade 12 is urged against a projection 17 at the front end of the other side of the handle 10. Also, the latch 14 slightly pivots outward to have its front end engaging the rear end of the blade 12 because of the elastic force released by the resilient latch 14. As an end, the blade 12 is locked.

The folding knife 1 is advantageous for being capable of using by one hand, simple in construction, easy to manufacture, compact, and portable. Moreover, a user may carry the folding knife 1 by hanging the clip 13 (see FIG. 2) on the clothes.

Referring to FIG. 3 again, after use a knife retracting operation of the preferred embodiment of the invention is described below. The blade 12 is disengaged from the latch 14 when a sufficient pressing force is exerted on the latch 14. Next, the blade 12 can retract onto the other side of the handle 10 by pivoting. In this closed position, the first positioning member 140 and the second positioning member 120 are matingly engaged together. Also, the cutting edge 122 of the blade 12 is disposed proximate the flange 18. The flange 18 thus serves as a guard for preventing the cutting edge 122 from accidentally cutting a user while carrying the folding knife 1 in its closed position.

In view of the above, the invention provides a folding knife 1 with a hollow handle 10 for fastening an item therein. It is contemplated by the invention that the invention has the following advantages. The folding knife 1 is simple in construction, easy to manufacture, and low in the manufacturing cost. Moreover, the lighter 2 mounted in the folding knife 1 is of conventional inexpensive type and is commercially available. It is easy to assemble the folding knife 1 and the lighter 2 together. Further, both the folding knife 1 and the lighter 2 are inexpensive. Hence, a user may not have the feeling of losing a precious thing when the folding knife 1 is lost accidentally.

While the invention herein disclosed has been described by means of specific embodiments, numerous modifications and variations could be made thereto by those skilled in the art without departing from the scope and spirit of the invention set forth in the claims.

What is claimed is:

1. A folding knife comprising:

a handle formed by bending a metal sheet into a shape of inverted U-section, the handle including a receiving space of inverted U-section defined by inner surfaces of the handle, the receiving space being adapted to fasten an item placed therein by securely urging substantially two parallel sides of the handle against the item, and a latch formed by punching one of the sides of the handle adjacent to the receiving space and extending in a direction away from the receiving space; and a blade having a proximal end pivotably secured to one end of the handle at the side of the handle having the latch and exterior to the receiving space, wherein the proximal end of the blade is lockingly fastened by the latch when the blade is in its opened position, and the blade is unfastened when a predetermined pressing force is exerted on the latch toward the receiving space such that the blade can pivotably retract onto the side of the handle having the latch.

2. The folding knife of claim 1, wherein the handle further comprises a lengthwise, outward extending flange formed by bending the edge of the side of the handle having the latch in a direction opposite to the receiving space, the flange being adapted to stop a cutting edge of the blade when retracting the blade onto the side of the having the latch.

3. The folding knife of claim 2, wherein the latch includes a first positioning member at a free end.

4. The folding knife of claim 3, wherein the blade includes a second positioning member on an inner surface at the one end thereof, the second positioning member being adapted to matingly engage the first positioning member when the blade is secured onto the side of the handle having the latch.

5. The folding knife of claim 4, wherein the handle further comprises a clip formed by punching on the other side of the handle adjacent to the receiving space in a direction opposite to the receiving space, the clip being adapted to hang the folding knife on clothes worn by a user.

* * * * *